US008898944B2

(12) United States Patent
Michel

(10) Patent No.: US 8,898,944 B2
(45) Date of Patent: Dec. 2, 2014

(54) CONVERTABLE HANG TAG AND METHOD FOR USE THEREOF

(71) Applicant: Joyce Michel, New York, NY (US)

(72) Inventor: Joyce Michel, New York, NY (US)

( * ) Notice: Subject to any disclaimer, the term of this patent is extended or adjusted under 35 U.S.C. 154(b) by 75 days.

(21) Appl. No.: 13/845,189

(22) Filed: Mar. 18, 2013

(65) Prior Publication Data

US 2013/0213831 A1 Aug. 22, 2013

Related U.S. Application Data

(63) Continuation-in-part of application No. 12/814,081, filed on Jun. 11, 2010, now Pat. No. 8,424,232.

(51) Int. Cl.

| | |
|---|---|
| ***G09F 3/10*** | (2006.01) |
| ***B65D 5/20*** | (2006.01) |
| ***G09F 3/00*** | (2006.01) |
| ***B65D 77/22*** | (2006.01) |
| ***B65D 5/30*** | (2006.01) |
| ***G09F 3/14*** | (2006.01) |
| *G09F 3/02* | (2006.01) |

(52) U.S. Cl.

CPC ..... *B65D 77/22* (2013.01); *B65D 5/2019* (2013.01); *G09F 2003/0282* (2013.01); *G09F 3/0289* (2013.01); *G09F 2003/027* (2013.01); *G09F 3/02* (2013.01); *G09F 2003/0272* (2013.01); *B65D 5/302* (2013.01); *G09F 3/14* (2013.01); *B65D 5/2033* (2013.01)

USPC ..... 40/672; 40/124.06; 40/661.04; 206/299

(58) Field of Classification Search

CPC .... B65D 5/302; B65D 5/6661; B65D 5/2057; B65D 5/2019; G09F 3/0289; G09F 2003/027; G09F 2003/0282; B31B 1/50

See application file for complete search history.

(56) References Cited

U.S. PATENT DOCUMENTS

| | | | | |
|---|---|---|---|---|
| 888,201 | A | 5/1908 | Strauss | |
| 1,138,788 | A | 5/1915 | Puley | |
| 1,201,054 | A | 10/1916 | Johnston | |
| 1,383,335 | A * | 7/1921 | Penksa | 40/6 |
| 1,975,804 | A | 8/1931 | Seifer | |
| 2,108,343 | A | 2/1938 | McAllister | |
| 4,620,630 | A | 11/1986 | Moss | |
| 2003/0217488 | A1 | 11/2003 | Chmiel et al. | |
| 2004/0244252 | A1 | 12/2004 | Phinney | |
| 2008/0048041 | A1 * | 2/2008 | Riley | 235/487 |
| 2008/0250689 | A1 | 10/2008 | Cohen | |
| 2010/0011634 | A1 | 1/2010 | Dweck et al. | |

* cited by examiner

*Primary Examiner* — Kristina Junge
(74) *Attorney, Agent, or Firm* — DLA Piper LLP (US)

(57) ABSTRACT

I provide a hang tag, preferably used for a saleable item such as clothing, that is convertible into a storage container. The storage container can then be used to store the purchased item. In a method of use, a user can remove the hang tag from a recently purchased saleable item of clothing, and, through a series of folds and interlocking of panels, create the storage containers in which the user could place the item.

20 Claims, 18 Drawing Sheets

Square I Closed

Open | Opened | Flat

CONVERTABLE HANG TAG AND METHOD FOR USE THEREOF

RELATED APPLICATIONS

This application is a continuation-in-part of U.S. Ser. No. 12/814,081 filed Jun. 11, 2010, the entire contents of which are incorporated herein by reference.

TECHNICAL FIELD

This disclosure generally relates to a device that can convertibly be used as a hang tag for an item and a container for the item.

BACKGROUND

Many items for sale, in particularly clothing items, utilize hang tags as a way to convey information about the item the tag is hanging from. Hang tags on garments today are usually used to convey information about a product including, but not limited to, a brand name, description of the garment, garment benefits, size information, price, fabric content, care instructions, marketing information, where the garment was manufactured, and distribution information. These hang tags are disposable and are not kept by the consumer. Hangs tags known in the art generally do not have any other purpose than to convey information such as listed above.

The items that the hang tags are attached to are typically stored somewhere after purchase. Most typically, this requires use of a dresser or similar furniture piece. Drawers can be messy with many small items. Drawer organizers are helpful but expensive. Moreover, the purchaser may be at an atypical location where they do not have access to their home storage areas or any storage areas at all. In these situations, a storage area can be separately purchased for the item, but the portability and disposability of such storage areas are lacking. Additionally, in today's world of being more ecologically friendly, re-purposing of any printed matter is important. Disposing of an item when it can serve a valuable purpose for the end user such as drawer organization is not environmentally efficient.

Therefore, a need exists in the art for hang tags that are utilized for reasons other than the display of information. There is a further need for such a device that provides an immediate and portable storage area for the purchased item and that can serve as a drawer organizer.

SUMMARY

I solve these needs and provide a novel hang tag with two foldable examples and method for using the same. The two foldable examples include a hang tag for providing information about an item and a storage area that can be used for the same said item.

This disclosure further contemplates a convertible hang tag formed from a foldable blank, the foldable blank including a front panel having a multiplicity of sides, at least three end panels hingedly attached to the sides of the front panel wherein each end panel includes at least one interlocking mechanism to interlock with an adjacent end panel; at least one front panel aperture in the front panel; and at least one end panel aperture in at least one of the end panels, wherein the at least one end panel aperture overlaps the at least one front panel aperture when the end panel containing the at least one aperture is hingedly folded toward the front panel.

This disclosure further contemplates a convertible hang tag for identification of clothes, including a front panel having a multiplicity of sides, at least three end panels hingedly attached to the sides of the front panel such that each side is hingeldy attached to at least one end panel, and wherein each end panel includes at least one opening and at least one tab extending outwardly from an edge thereof, such that the at least one tab of one panel can interlock with at least one opening of an adjacent panel to form a storage area.

This disclosure further contemplates a method for converting a tag for identifying an item into a container, including the steps of unfolding a tag to provide a front panel having a multiplicity of sides and at least three end panels hingedly attached to the sides of the front panel, and interlocking the end panels together to form a storage area.

BRIEF DESCRIPTION OF THE DRAWINGS

Without restricting the full scope of my disclosure, various preferred forms of the disclosure and its related articles are illustrated in the following drawings.

DETAILED DESCRIPTION

Figure 1:
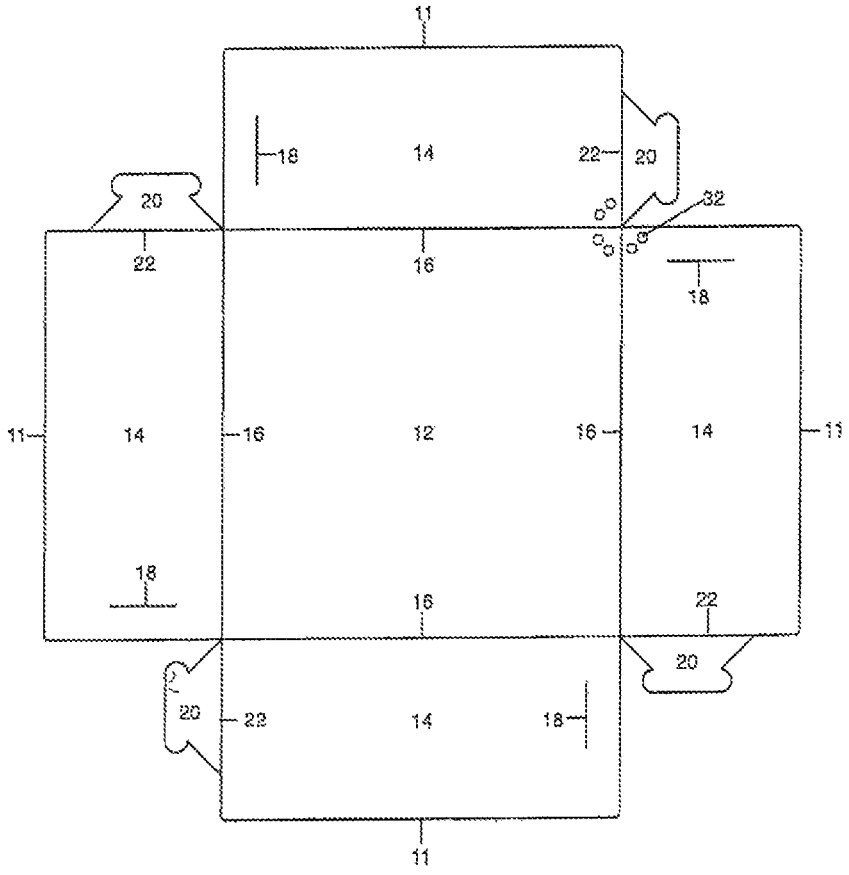
FIG. 1 is a plan view of a hang tag blank having four end panels.

FIG. 1 shows a foldable blank combination device generally designated by reference number 10. As discussed below, blank 10 can be folded into either a tag that can hang off an item, typically a piece of saleable merchandise, or placed into a container for holding the same item. Blank 10 includes front panel 12 and at least three end panels 14 that are hingedly attached to front panel 12. In preferred examples, end panels 14 are hingedly attached to front panel 12 along fold lines 16 with outer edges 11 that are at least the same length as fold line 16. In alternate examples, end panels can be attached to front panel 14 with other devices, such as binding or laced string, that allow for relative, hinged movement between the front and end panels.

Figure 10:
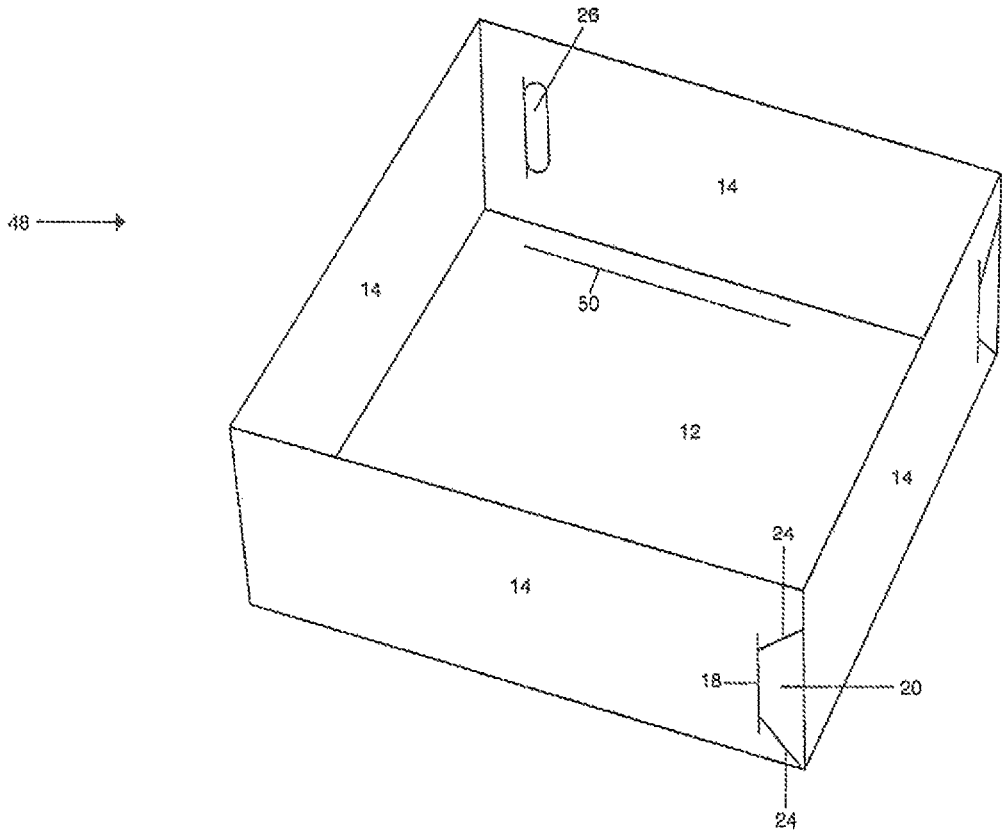
FIG. 10 is a top perspective view of the second folded example.

FIG. 1 shows a preferred example of a symmetrical blank 10 having four end panels of substantially the same size. The number of end panels can vary widely while maintaining the advantages can include substantially any number greater than two. For example, FIG. 10 shows a blank having eight side panels. It will be understood by one skilled in the art that changing the number of end panels will change the shape of the ultimately formed tag or container without substantially changing the functionality. In preferred examples, the number of sides of front panel 12 is equal to the number of end panels, but it is not required. Due to this variety, front panel 12 can be a variety of shapes depending on the number of end panels 14 used. In one preferred example, shown in FIG. 1, front panel 12 is substantially a square shape. At least one aperture 32 is formed in front panel 12 or end panel 14. Apertures 32 are used to hang the device from an item in one of the devices functional examples. As shown in FIG. 1, blank 10 can include two apertures 32 of circular shape. One skilled in the art could understand, however, that the shape or even the number of apertures can vary within the spirit of my disclosure.

Blank 10 is preferably made of any foldable material known in the art. Most typically, blank 10 would be of a paper material having enough stiffness to enable portions of the blank to be folded in an upward direction. Alternatively, the blank 10 may be made from a more rigid material that is scored, perforated, hinged, indented or the like to allow folding at predetermined locations. The size of the blank can be increased or decreased in scale as needed.

Figure 2:
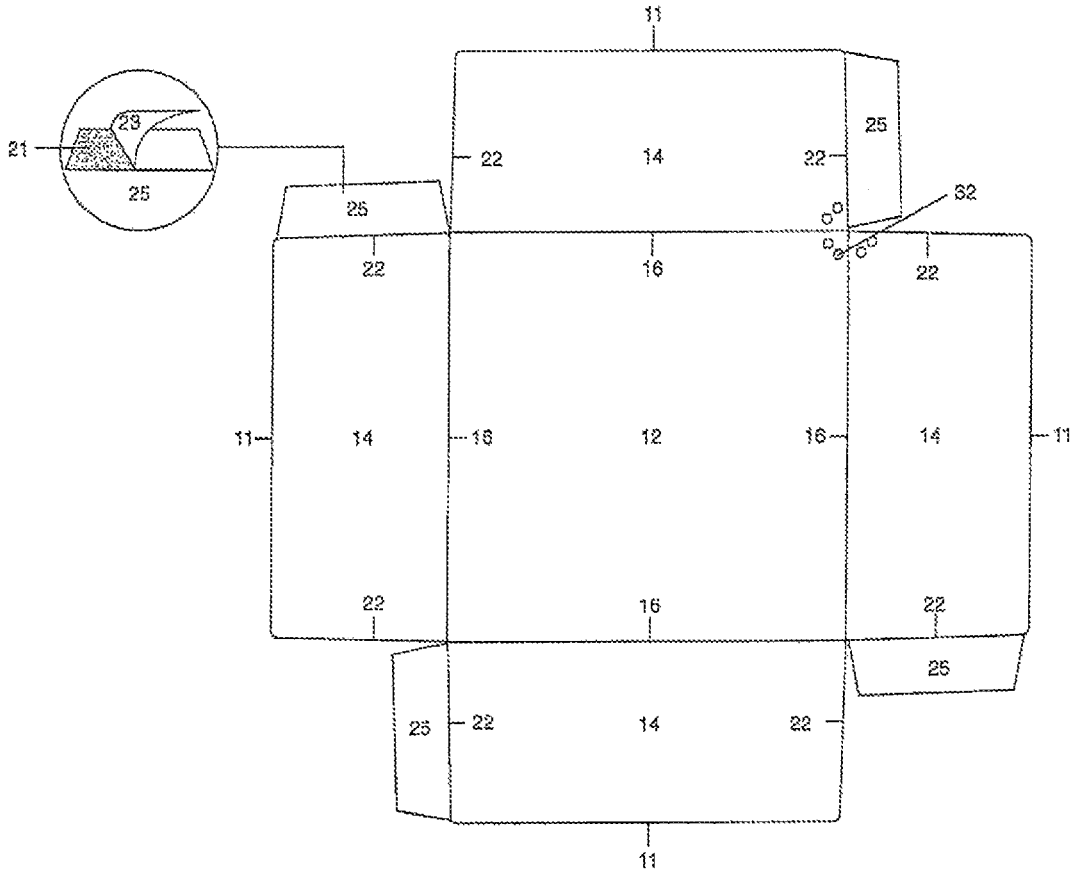
FIG. 2 is a plan view of a second example of the hang tag with adhesive closures.

In preferred examples, each end panel includes at least one opening 18 and at least one tab 20 hingedly extending from side 22. For simplicity's sake, the preferred examples have each panel including only one opening 18 and only one tab 20 as pictured in FIG. 1. It is conceivable, however, to have multiple tabs and openings on each panel. For example, an end panel 14 could have two tabs substantially next to one another on side 22 and two corresponding openings also next to each other. In alternate examples, any interlocking mechanism known in the art can be utilized. For example, as shown in FIG. 2, an alternate interlocking mechanism example comprises a tab 25 that includes a peel away paper 23 on an adhesive strip 21. In the example shown in FIG. 2, end panels 14 do not require openings 18.

Figure 3:
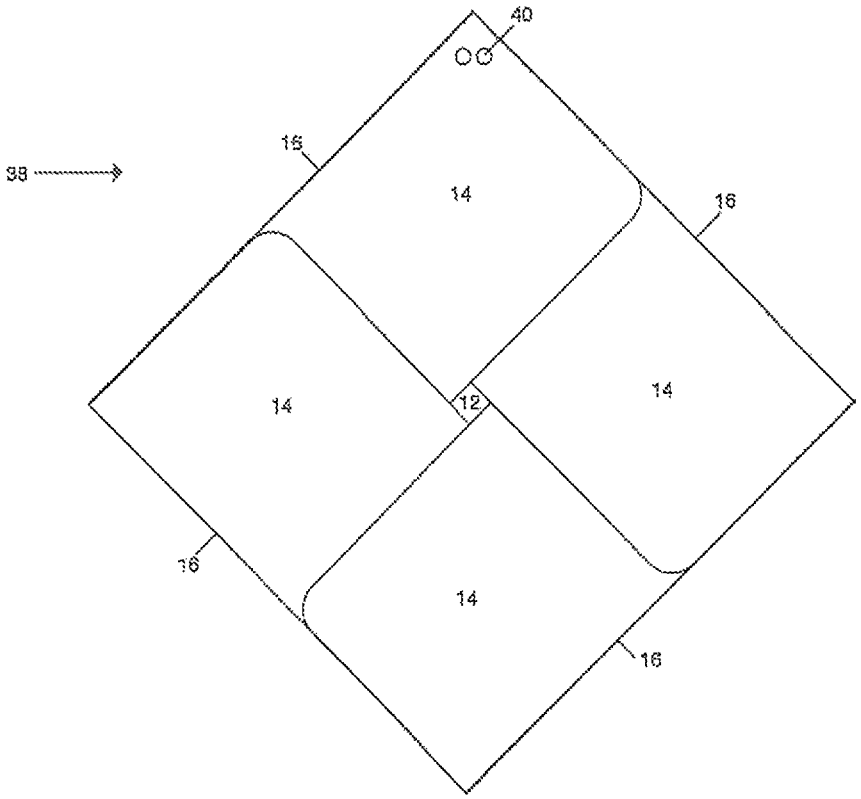
FIG. 3 is a back view of the second folded example of the hangtag.
Figure 4:
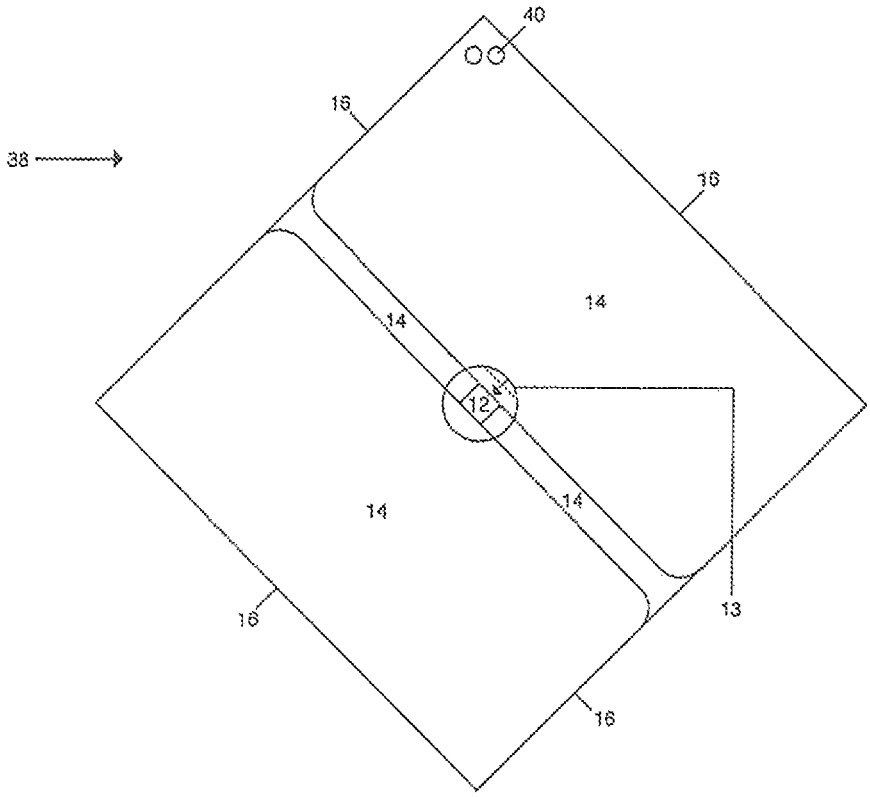
FIG. 4 is a closed view of a first example with a sticker closure.
Figure 5:
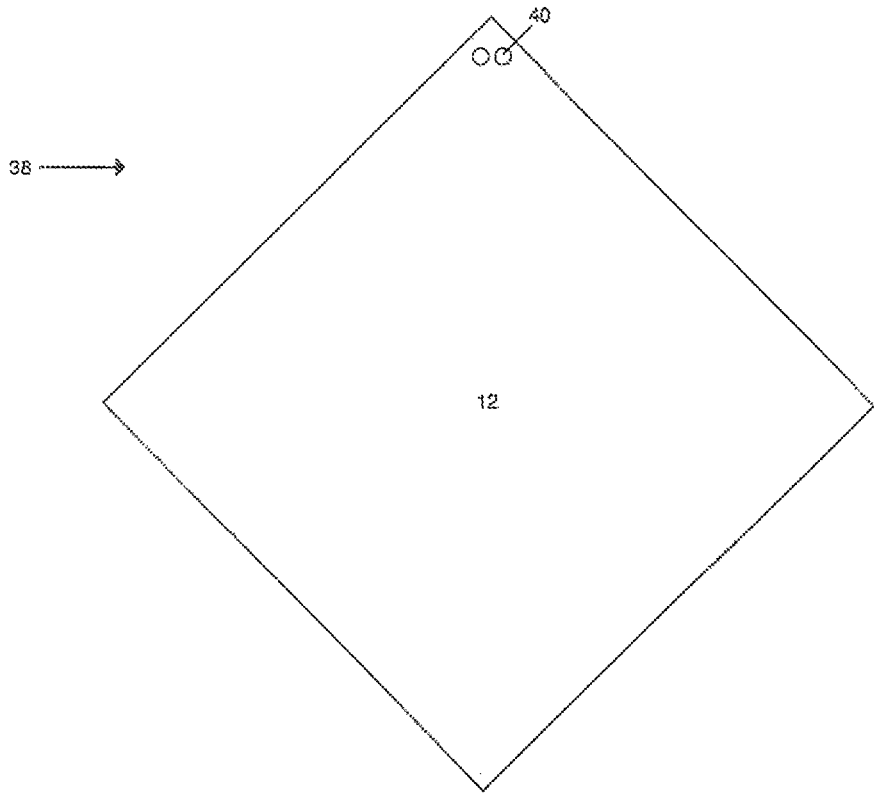
FIG. 5 is a front view of the first folded closed example of the hang tag.

FIGS. 3-5 show a first folding example of blank 10 into tag 38. Each end panel 14 is hingedly moved along fold lines 16 toward front panel 12. The end panels are folded as shown in FIG. 3 such that each end panel partially overlaps a first adjacent end panel and is in turn partially overlapped by a second adjacent panel. The end panels are held in place by the friction and pressure provided by the other end panels. In this foldable example, the panels are not interlocked by openings 18 or tabs 20. Tabs 20 are folded inwardly and are not visible or in use when tag 38 is formed. In another example, shown in FIG. 4, the end panels can also be folded to overlap opposite panels and held in place with a tag securing mechanism, such as removable sticker 13.

Figure 6:
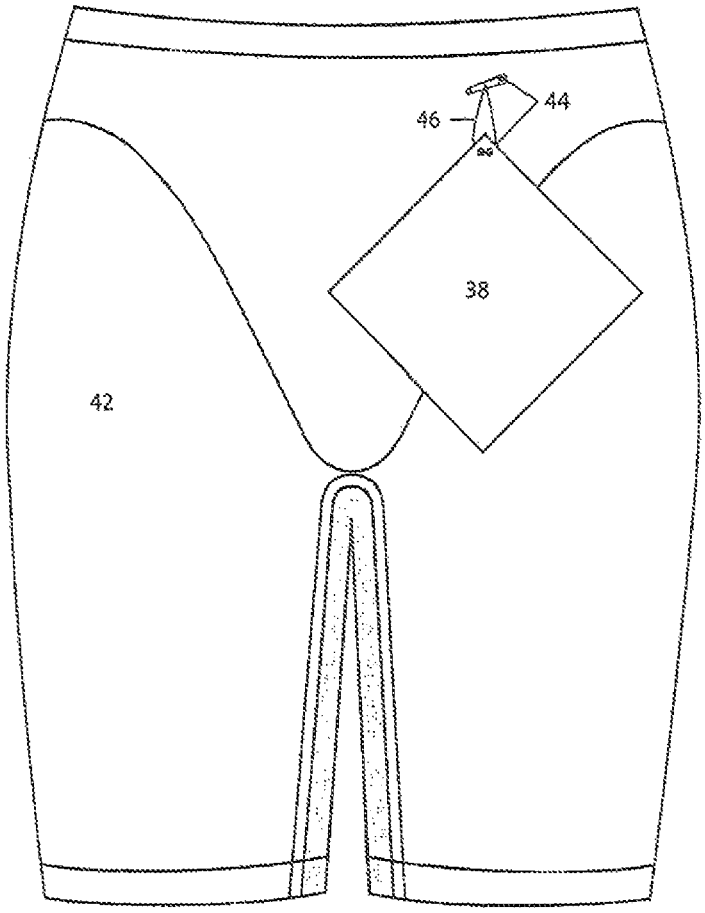
FIG. 6 is a front view of the first folded example on an item.

When the panels are folded into tag 38, the apertures 32 are folded on top of one another such that a deeper aperture 40 is created, having the thickness of one front panel and at least one side panel. As shown in FIG. 3, aperture 40 is visible from the front side of tag 38. FIG. 6 shows tag 38 attached to an item 42. In preferred examples, item 42 is a saleable merchandise wherein tag 38 provides identifying information for it. To best take advantage of the features of the box, item 42 is foldable such that it can later fit into the container folded example depicted in FIGS. 8-12. Most typically, this would be a clothing item, one example of which is FIG. 6. In preferred examples, the tag is provided on items such as underwear, jock straps, sports bras, bras, athletic apparel, bike shorts, capri pants, shirts, t-shirts, camisoles, shapers, longline underwear, pantyhose, shaping pantyhose, leggings and boy shorts. One skilled in the art would understand, however, that the tag could be used on numerous other products as well.

Tag 38 is attached to item 42 using a fastening device or assembly 44. In preferred examples, the tag is attached to the item via at least one aperture in the tag. In these examples, fastening assembly 44 includes a pliable material 46 such as a string that is entered through the apertures 40 of tag 38 and a fastener 46 such as a safety pin. As one skilled in the art would understand, however, other types of fastener assemblies could be used with aperture 40 to attach tag 38 to item 42 such as a tag gun.

Any portion or side of front panel 12 or an end panel 14 of tag 38 can be imprinted with any type of printing desired. Most typically, this will be identifying information such as a logo of the clothing manufacturer, care instructions, reordering information, contact information, folding instructions, country of origin, materials and material percentages and the like. Tag 38 can also be imprinted with any color or design.

Figure 7:
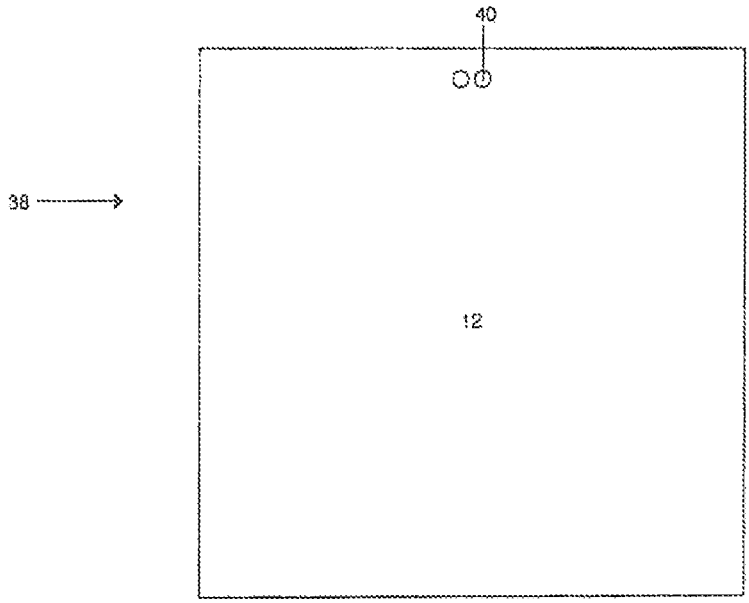
FIG. 7 is a front view of a square first folded example.

In the example in FIGS. 3-5, apertures 40 are shown in a corner of tag 38. This creates a diamond-shaped tag as it hangs off of item 42, as shown in FIG. 5. In alternate examples, apertures 40 can be located in other locations around the tag. One such example is shown in FIG. 7, wherein the apertures 40 are substantially centered along one side of front panel 12. To create this example, apertures 32 of FIG. 1 will have to be located elsewhere on blank 10. This example will create a square tag 38 as it hangs off item 40. As would be readily understood, the apertures can be located elsewhere on the tag other than those locations depicted in FIGS. 1-7.

Figure 8:
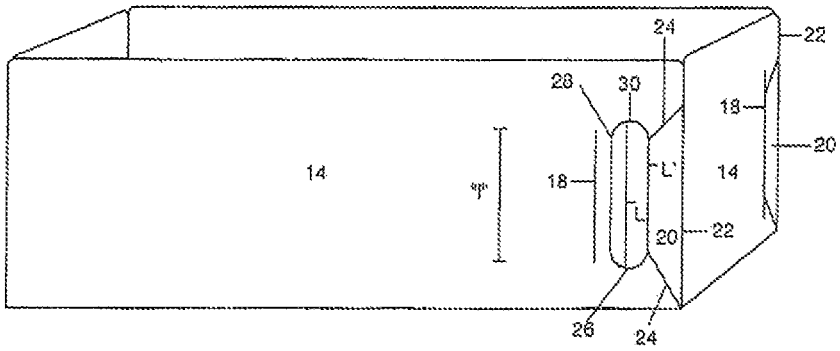
FIG. 8 is a side perspective view of the hang tag blank being folded into a second folded example.

As shown in FIGS. 8-11, blank 10 can be folded into a second folding example. As shown in FIG. 8, at least one tab 20 of end panel 14 is entered into an opening 18 of an adjacent end panel 14, thereby interlocking the two adjacent panels together. Each tab extends from side 22 of end panel 14 and is designed to fit into an opening 18 in a substantially adjacent end panel. One skilled in the art will understand that the precise shapes and sizes of tabs 20 and openings 18 can vary widely while still maintaining the same functionality. In preferred examples, tabs 20 includes opposing converging sides 24 that converge as tab 20 extends from side 22. Converging sides 24 extend to a crown 26 having a flat top side 28 and rounded sides 30. Rounded sides 30 meet converging sides 24 at two opposing indents 36.

Figure 9:
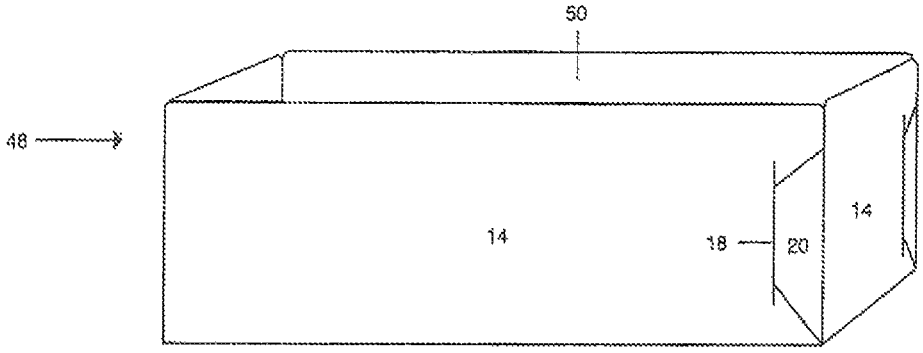
FIG. 9 is a side perspective view of the second folded example.

Opening 18 is preferably a slit through which a portion of tab 20 can fit through, thereby interlocking two adjacent side panels. In this example, a length "l" of opening 18 is smaller than a length "L" of crown 26 but greater than the length "$L^1$" between the converging sides 24. Opening 18 can accept crown 26 if crown 26 is entered on through opening 18 on a suitable angle. After entry, opening 18 can hold crown 26 on one side of the opening while the remainder of tab 20 is on the other side of the opening, thereby interlocking adjacent end panels 14 as shown in FIG. 9.

Each tab 20 is entered into an opening in an adjacent end panel, interlocking the end panels together, until a container 48 is formed. As shown in FIG. 9, completed container 48 provides a storage area 50 into which items can be placed. In preferred examples, shown in FIG. 12, the item placed in storage area 50 is the same item 42 to which tag 38 was attached. To this end, a purchaser can buy an item 42 and simultaneously receive a storage container for the item that can be used as needed. This provides a purchaser with an inexpensive, portable and disposable alternative to purchases requiring separate boxes or containers to hold their purchases.

Figure 11:
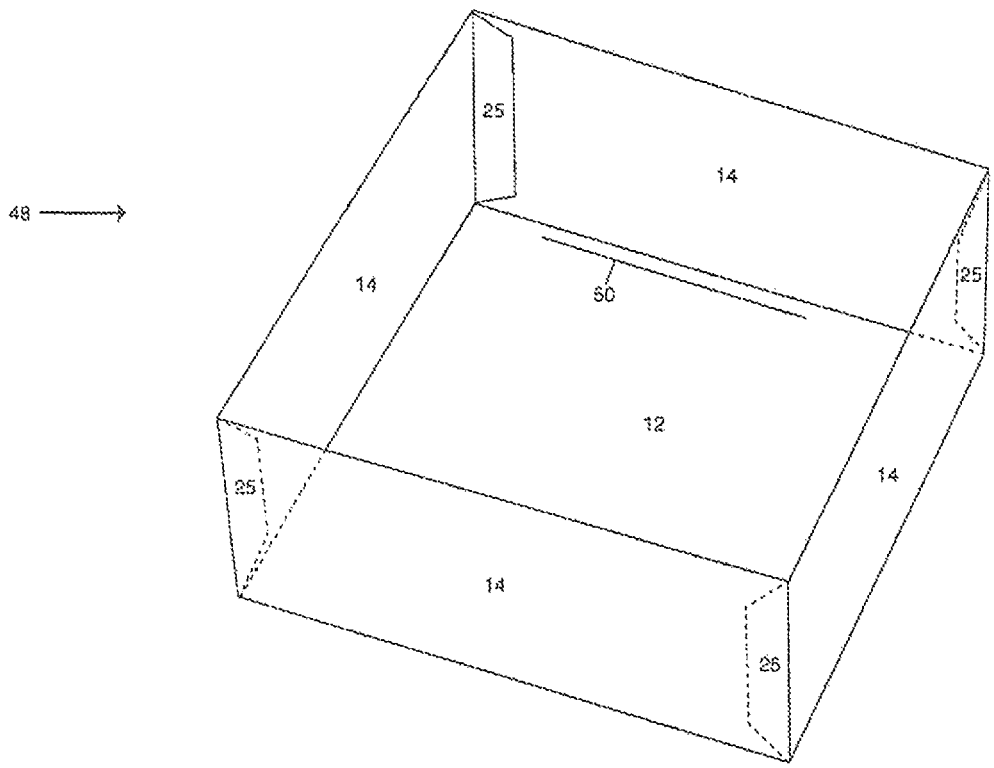
FIG. 11 is a top perspective of a second folded example with adhesive closures.
Figure 12:
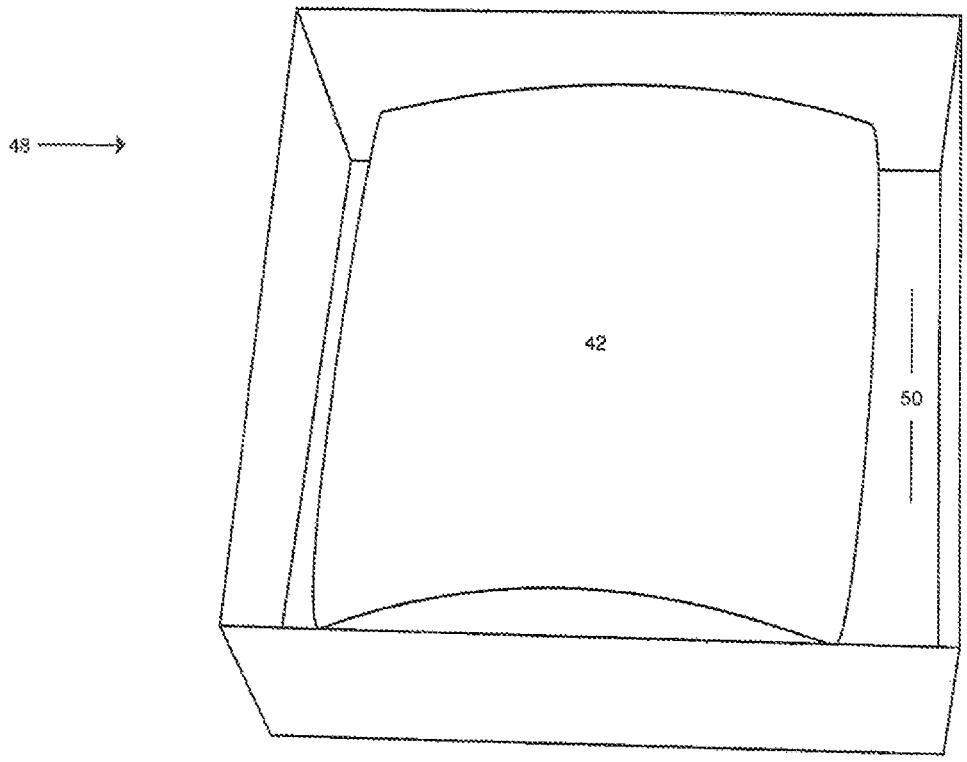
FIG. 12 is a top perspective view of the second folded example containing an item.

FIG. 11 shows an alternate example wherein a container is formed when self adhesive tabs 25 are adhered onto adjacent end panels 14.

I thereby provide a method for storing an item by converting a tag for identifying an item into a storage container for the item. The method includes the steps of unfolding a tag to provide a front panel having a multiplicity of sides and at least three end panels hingedly attached to the sides of the front panel and interlocking the end panels together to form a storage area. The item can thereafter be stored in the storage area. The resulting storage area is also preferably stackable with other like storage areas formed from like tags.

Figure 13:
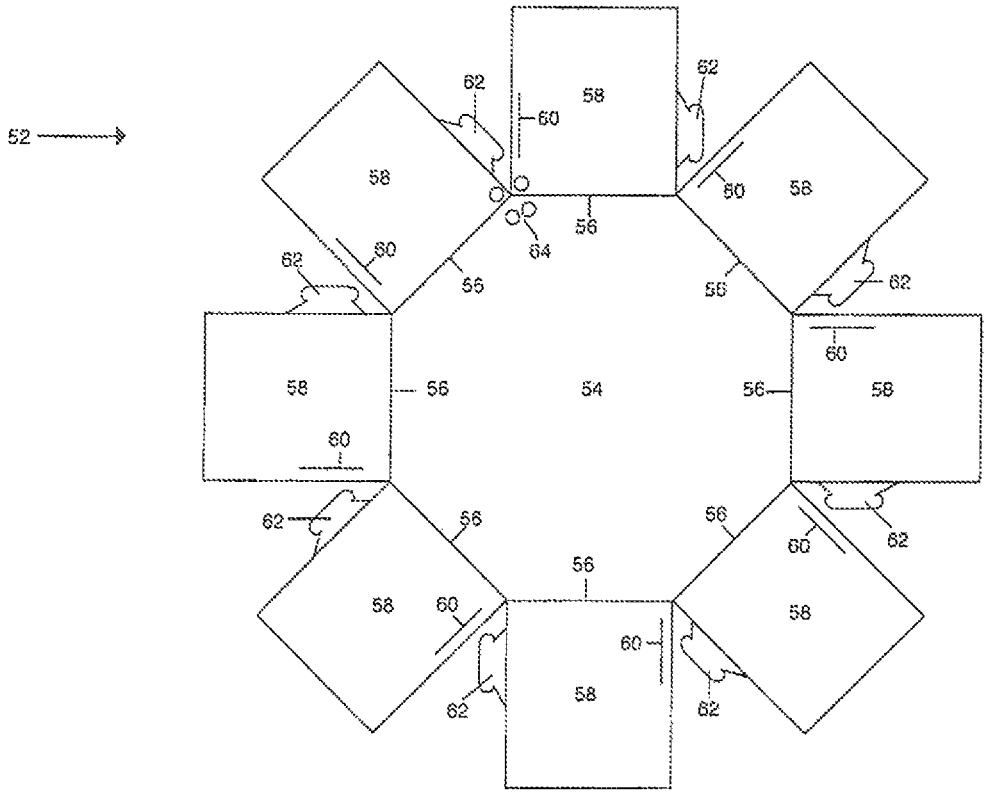
FIG. 13 is a plan view of a hang tag blank having eight end panels.
Figure 14:
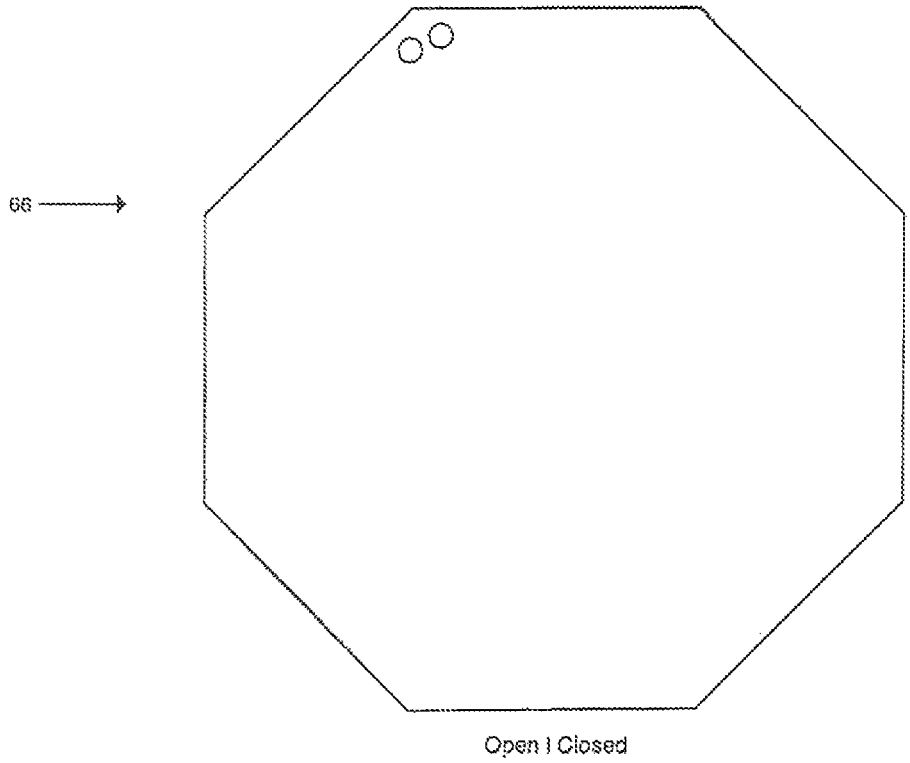
FIG. 14 is a front view of a first folded example of the hang tag having eight end panels.

In further examples, the combination device can come in various shapes. FIGS. 13-14 show an octagonal combination device that can be folded into two separate folding examples. Blank 52 includes an octagonal front panel 54 having sides 56. At least one aperture 64 is cut into the front panel at a location near sides 56. Eight end panels 58 are attached to each side 56, creating fold lines at each side 56. Each end panel 58 includes at least one opening 60 and at least one tab 62. At least one of the end panels includes at least one aperture to overlap at least one aperture 64 on the front panel. As shown in FIG. 13, front panel 54 includes two aperture holes and two adjacent end panels 58 have one aperture each, such that when the end panels are folded toward each other, each aperture of the adjacent end panels cover one aperture of the front panel. In alternate examples, the apertures are in different locations on blank 52.

Functionally, FIG. 13 octagonal blank 52 is the same as blank 10 of FIG. 1. Each end panel 58 can be folded along fold lines 56 toward front panel 54 such that each end panel overlaps one adjacent end panel and is overlapped by an opposing adjacent end panel. This forms a first foldable example that can be hung from a saleable item as a tag 66 as shown in FIG. 14. Tag 66 can be imprinted with any design desired such as a clothing logo. Alternatively, each end panel 58 includes at least one opening 60 and at least one tab 62 such that they can be interlocked together to form a storage area for the saleable item. In this example, the storage area has a generally octagonal shape. As could be readily understood by one skilled in the art, the combination device can include substantially any number of sides and any number of panels greater than two and any known interlocking mechanism known in the art such as a peel away strip can be utilized.

Figure 15:
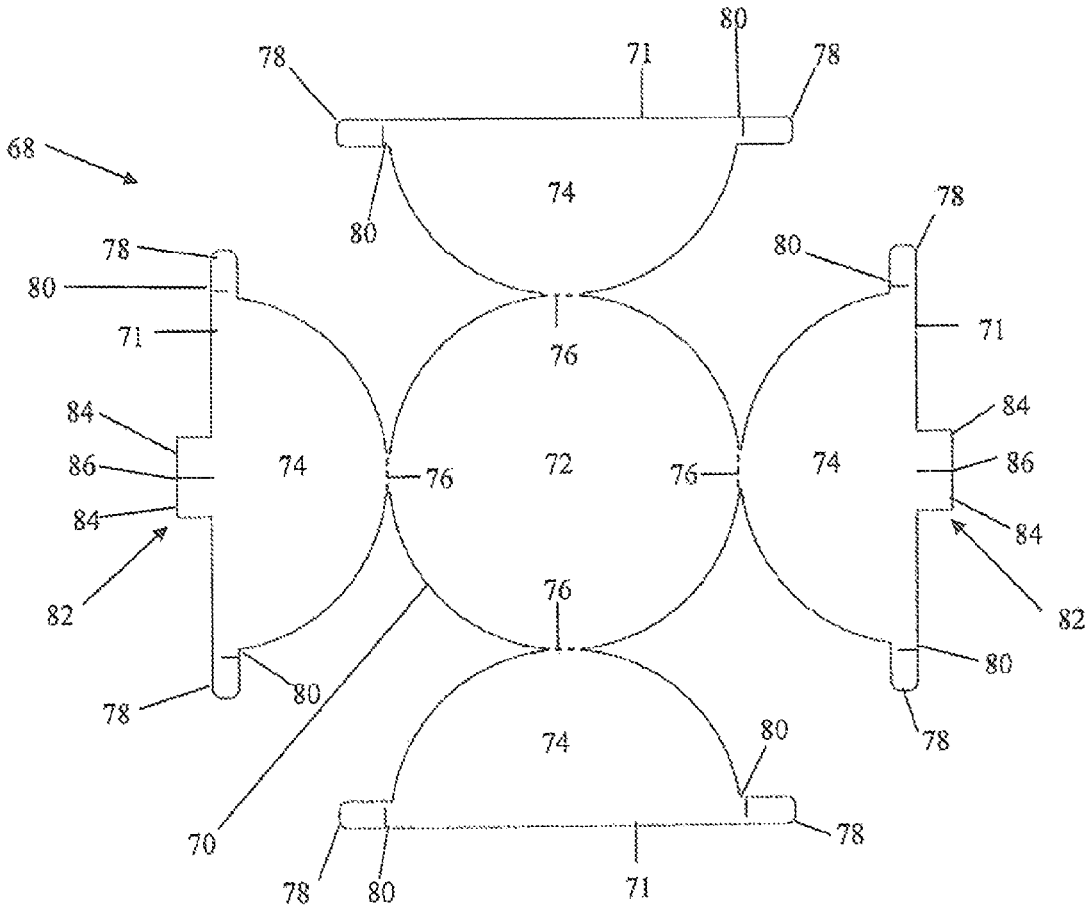
FIG. 15 is a flat view of a further example a hangtag.

FIG. 15 depicts a further alternate example of a tag 68 formed from a foldable blank 70. Blank 70 includes front panel 72 and at least three end panels 74. As shown in FIG. 15, the front panel 72 defines a generally rounded shape and has four end panels 74 hingedly attached thereto along fold lines 76 positioned at the outer perimeter 69 of the front panel 72. The blank 70 may be provided with a generally circular front panel 72 four end panels 74 that are generally semi-circular in shape, each of which are approximately the same size and approximately half the size of the front panel 72. As shown, the outer edges 71 of end panels 74 have a length substantially the same as the diameter of the front panel 72. However, additional end panels 74 or arrangements are possible. Additionally, the front panel 72 may be generally oval or elliptical and the end panels 74 may be a portion of an oval or ellipse.

As shown in FIG. 15, each end panel 74 includes at least one tab 78 hingedly extending from a corner of the end panel 74 generally parallel to the outer edge 71. Preferably, end panels 74 are provided with a tab 78 hingedly extending from each corner of the end panel 74.

As shown, tabs 78 are provided with a notch or slit 80 extending orthogonally to the outer edge 71 through a portion of the tab 78. As shown, a notch or slit 80 may be positioned on the tab 78 either along the outer edge 71 of the end panel 74 or along the edge of the tab 78 facing the front panel 72. For example, the notch or slit 80 may be positioned on one side of the tab 78 along the outer edge 71 whereas the slit or notch 80 of nearest tab 78 of an adjacent end panel 74 is positioned along the edge of the tab 78 facing the front panel 72. Alternating the positioning of the notch 80 on adjacent edge panels 74 allows for adjacent tabs 78 to interlock. Alternatively, one or more tabs 78 may be provided with an interlocking mechanism similar to that of FIG. 1 or 2 or any other suitable interlocking mechanism.

Additionally, as shown in FIG. 15, a tag securing mechanism 82 may be provided to assist in retaining the hang tag 68 in a first folded configuration. More preferably, tag securing mechanisms 82 may be provided on at least two end panels 74 positioned on opposite sides of the front panel 72. Where provided, the tag securing mechanism 82 may define two rectangular shaped tabs 84 separated by a notch or slit 86 and extending orthogonally from the central portion of the edge 71. End panels 74 provided with a tag securing mechanism 82 are identified in FIG. 15 as 74*a* and end panels 74 not provided with a tag securing mechanism 82 are identified in FIG. 15 as 74*b*.

Figure 16:
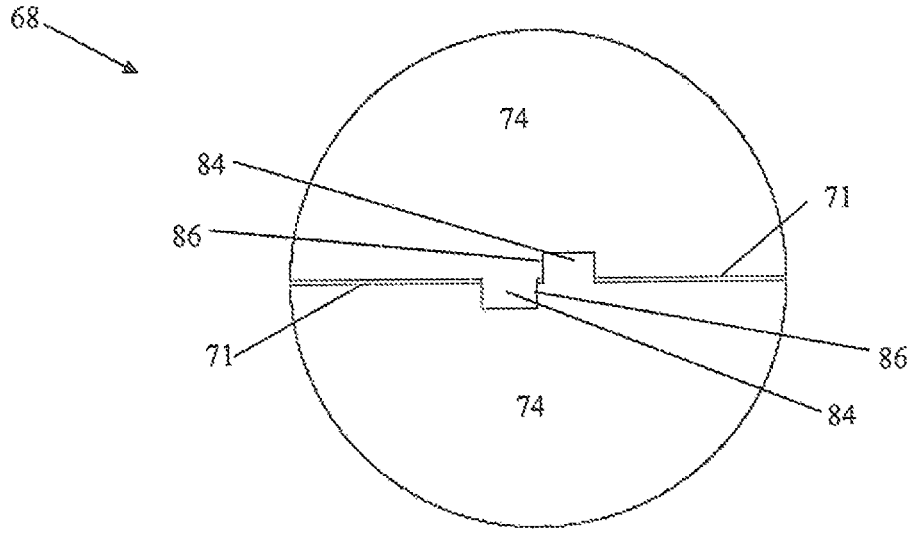
FIG. 16 is a plan view of the hangtag of FIG. 15 when folded into a first folded example.

FIG. 16 shows a first folding example of blank 70 folded into tag 68 wherein each end panel 74 is hingedly folded along fold lines 76 toward front panel 72. Preferably the two opposing end panels 74*b* not provided with a tag securing mechanism 82 are folded first such that the end panels 74*b* at least partially overlap the front panel 72. Subsequently, the two opposing end panels 74*a* having tag securing mechanisms 82 are folded such that these two end panels 74*a* at least partially overlap the other two end panels 74*b* not provided with a tag securing mechanism 82.

The tag securing mechanism 82 of the opposing end panels 74*a* can be engaged by interlocking the slits 86 so that one tab 84 of a tag securing mechanism 82 is positioned over the opposing end panel 74*a* and the other tab 84 of the tag securing mechanism 82 is positioned under the opposing end panel 74*a*. Alternatively, the end panels 74 can be secured using a mechanism shown in FIGS. 3 and 4 or any other suitable mechanism. In this folded example, the end panels 74 are not interlocked by tabs 78. Tabs 78 are folded inwardly and are not visible or in use when tag 68 is formed.

Figure 17:
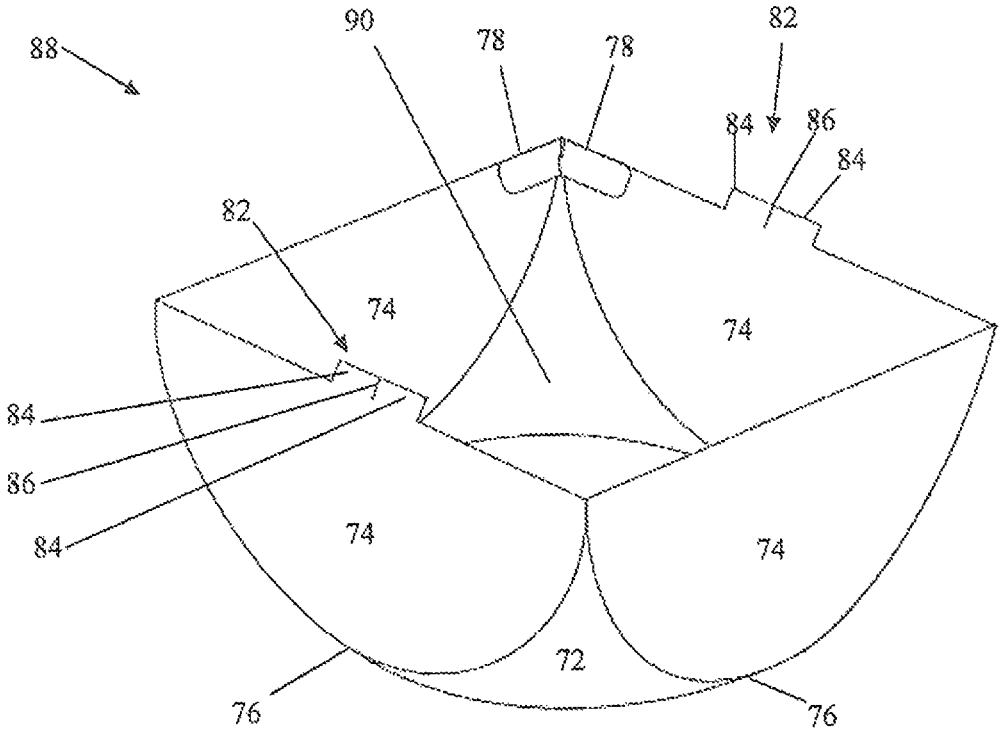
FIG. 17 is of a side perspective view of the hangtag of FIG. 15 folded into a second folded example.
Figure 18:
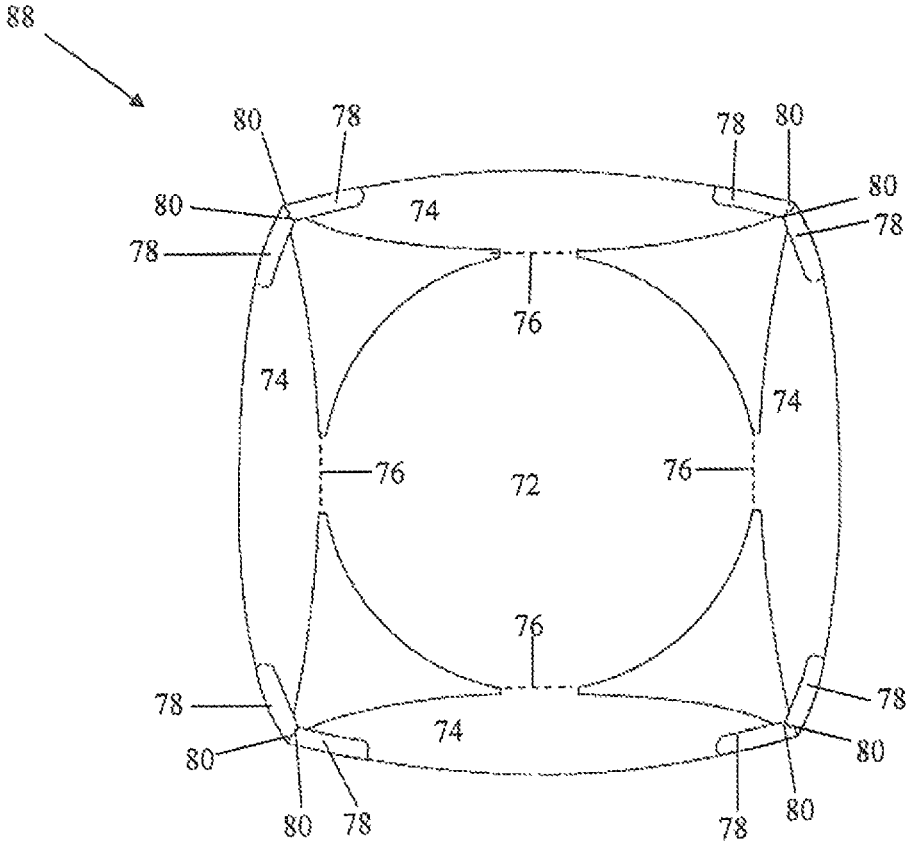
FIG. 18 is of a plan view of the hangtag of FIG. 15 folded into a second folded example.

As shown in FIG. 17, blank 70 can be folded into a second folding example. As shown in FIGS. 17 and 18, the slit or notch 80 of one tab 78 of end panel 74 can be brought into interlocking engagement with the slit or notch 80 of a tab 78 of an adjacent end panel 74, thereby interlocking the two adjacent panels 74 together. Each tab 78 is interlocked with a tab 78 of an adjacent end panel 74, interlocking the end panels 74 together, until a container 88 is formed. As shown in FIGS. 17 and 18, completed container 88 provides a storage area 90 into which items can be placed. As shown, the storage area 90 has a generally rectangular shaped cross-section.

I create a method and apparatus for identifying an item of sale and storage of the item after purchase. Various changes and modifications can be made without departing from its scope or spirit. For example, each end panel does not have to be identical in shape, and can have varying lengths and widths as relative to each other.

While the preferred examples of my disclosure have been shown and described, it will be apparent to those skilled in the art that changes and modifications may be made therein without departing from the spirit of my disclosure, the scope of which is defined by the appended claims.

What is claimed is:

1. A hang tag convertible from a folded configuration to a storage container configuration formed from a foldable blank, the foldable blank comprising:

a front panel having an outer perimeter;

at least three end panels hingedly attached to the outer perimeter of the front panel such that each end panel is hingedly attached to the front panel, wherein each end panel includes at least one interlocking mechanism to interlock an adjacent end panel;

at least one tag securing mechanism that retains the hang tag in the folded configuration; at least one front panel aperture in the front panel; and at least one end panel aperture in at least one of the end panels, wherein the at least one end panel aperture overlaps the at least one front panel aperture when the end panel containing the at least one aperture is hingedly folded toward the front panel, wherein all end panels are folded behind a front surface of the front panel when the hang tag is in the folded configuration.

2. The tag and container of claim 1, wherein the front panel is substantially rounded.

3. The tag and container of claim 1, wherein the front panel is substantially circular.

4. The tag and container of claim 3, wherein each end panel is substantially semi-circular.

5. The tag and container of claim 1, wherein the interlocking mechanism of each end panel includes at least one tab extending outwardly parallel to an outer edge of the end panel.

6. The tag and container of claim 1, wherein the front panel contains an imprinting.

7. The tag and container of claim 1, wherein the front panel contains two front panel apertures.

8. The tag and container of claim 7, wherein two adjacent end panels each have one end panel aperture.

9. The tag and container of claim 1, wherein the apertures of the front panel are substantially near at least one side.

10. The tag and container of claim 1, wherein the storage container configuration defines a storage space having a generally rectangular cross-section.

11. A tag for identification, comprising:

a front panel having an outer perimeter and at least one front panel aperture; at least three end panels hingedly attached to the outer perimeter of the front panel such that each end panel is hingedly attached to the front panel, wherein each end panel includes interlocking means; and one tag securing mechanism that retains the hang tag in the folded configuration, and wherein the hang tag is attached to a saleable item via the front panel aperture.

12. The tag for identification of claim 11, further comprising a saleable item, wherein the tag is attached to a saleable item.

13. The tag for identification of claim 11, wherein the front panel is rounded.

14. The tag for identification 11, wherein the front panel is circular.

15. The tag for identification of claim 11, further comprising at least one end panel aperture in at least one of the end panels, wherein the at least one end panel aperture overlaps the at least one front panel aperture when the end panel containing the at least one aperture is hingedly folded toward the front panel.

16. A method for converting a tag made according to claim 11 into a storage container, comprising the steps of:

detaching the hang tag from a saleable item, unfolding the hang tag to provide a front panel having an outer perimeter and at least three end panels hingedly attached to the outer perimeter of the front panel, and interlocking the end panels together to form a storage area.

17. The method of claim 16, further comprising the step of placing the item into the storage area.

18. The method of claim 16, wherein the tag is removed from the item prior to unfolding it, the tag is attached to the item via at least one aperture in the tag.

19. The method of claim 16, wherein the storage area is stackable with another like storage area.

20. The method of claim 16, wherein the storage area is generally octagonal in shape.

* * * * *